United States Patent [19]

Scott et al.

[11] Patent Number: 4,678,437

[45] Date of Patent: Jul. 7, 1987

[54] CARTRIDGE AND TARGET DEVICE FOR MARKMANSHIP TRAINING

[75] Inventors: Bentley N. Scott, Richardson; Vernon R. Porter, Plano; Samuel R. Shortes, Lewisville, all of Tex.

[73] Assignee: Technology Network International, Inc., Richardson, Tex.

[21] Appl. No.: 781,047

[22] Filed: Sep. 27, 1985

[51] Int. Cl.[4] ..... G09B 9/00

[52] U.S. Cl. ..... 434/21; 273/310

[58] Field of Search ..... 434/20, 21, 22; 273/310, 311, 312; 362/110, 111, 112, 113, 802; 200/62, 159 B

[56] References Cited

U.S. PATENT DOCUMENTS

| | | | |
|---|---|---|---|
| 3,214,173 | 10/1965 | Vidal | 273/310 |
| 3,471,945 | 10/1969 | Fleury | 434/21 |
| 4,102,059 | 7/1978 | Kimble et al. | 273/310 X |
| 4,156,802 | 5/1979 | Gilano et al. | 200/159 B X |
| 4,234,911 | 11/1980 | Faith | 273/310 X |

FOREIGN PATENT DOCUMENTS

| | | | |
|---|---|---|---|
| 2445505 | 8/1980 | France | 273/310 |

OTHER PUBLICATIONS

"Lep", *Elektor*, vol. 1, No. 6, pp. 942–944, Sep. 1975.

"An Advanced Combat Training System Using Lase Simulation", *National Defense*, 5/82, pp. 31–32.

*Primary Examiner*—Leo P. Picard

*Assistant Examiner*—Stuart W. Rose

*Attorney, Agent, or Firm*—Kanz, Scherbach & Timmons

[57] ABSTRACT

Marksmanship training apparatus which provides for simulated firing of projectile-type weapons is disclosed and comprises a substitute cartridge and a receiver/detector target device. The substitute cartridge is self contained and includes a power source, an energy emitting device which emits a pulse or pulses or energy with predetermined characteristics, a lens device to concentrate the emitted energy, an energy activation device and a transfer device to transfer the energy from the firing mechanism of the weapon to the energy activation device to activate same. The receiver/detector target device includes devices to detect the presence of the pulse or pulses of energy while ignoring the ambient light level surrounding the target device. The target device initiates a time cycle and provides a display of the elapsed time from initiation to the receipt of a hit from the pulse or pulses of energy emitted from the substitute cartridge in the weapon. An audio indication is also provided when a hit occurs.

9 Claims, 9 Drawing Figures

CARTRIDGE AND TARGET DEVICE FOR MARKMANSHIP TRAINING

BACKGROUND OF THE INVENTION

1. Field of the Invention

The present invention relates in general to new and improved apparatus for use in marksmanship training. More particularly, the present invention relates to apparatus to allow the aiming and simulated firing of projectile-type weapons, such as pistols, rifles, shotguns, military weapons, etc. and which, in one embodiment, provides an indication of a hit on the target as well as an indication of the time required to obtain the hit as measured from an initiation time to commence the simulated firing. This invention also provides a means to prevent ambient light from alternating voltage lighting systems from interfering with registration of a proper hit from the apparatus. Means by which multiple users may be identified is also disclosed.

2. Description of the Prior Art

It is well known that the best way to develop firearms marksmanship is actual firing at the target where the results are immediately visually perceptible. The firing of live ammunition, however, is expensive, noisy, incurs certain risks and consumes considerable time in preparation, transportation, range delays, target inspection, etc.

Various prior art devices have been devised which substitute the emission of light for the discharge of live ammunition to train one in the aiming and use of firearms. Unfortunately, all of the prior art devices suffer from one or more major limitations. For example, many such devices are bulky, unwieldy and otherwise difficult to use. Many require major modification of the firearm to accept the training device and render the firearm (at least temporarily) inoperative to fire live ammunition. Most require a direct linkage to the trigger and/or otherwise interfere with the feel or balance of the weapon so that use thereof does not properly condition the user for the feel or balance of the same weapon when live ammunition is used. Most such devices, however, suffer an even more serious limitation in that they are adaptable to and useable only in connection with a single weapon design, e.g. revolvers but not in automatics or rifles. For example, U.S. Pat. No. 4,367,516 discloses a conversion kit for a revolver by which the cartridge chamber of the revolver is replaced by a cylinder having a radiant energy emitting unit and a lens tube is inserted into the barrel of the revolver. The lens tube includes dual beam adjustment screws. Since all cylinders are custom fitted, this may preclude proper operation due to mechanical interference.

U.S. Pat. No. 3,471,945 discloses a light emitting cartridge for a shotgun which includes a time delay circuit therein which provides a delay between the closing of the firing pin actuated switch and the emission of light from the cartridge contained bulb. This cartridge was primarily for simulation of the necessity for firing ahead of a target in order to achieve a hit, such as in trap and skeet shooting.

U.S. Pat. No. 3,510,965 discloses an electrically actuated light bulb and focusing lens which inserts into the barrel of a revolver. Energy for lighting the bulb is connected to one electrode of the bulb through the portion of the device in the barrel and to the other electrode through the metal portion of the revolver. This apparatus can only be used in a revolver since a weapon such as an automatic pistol would not have an adjacent cylinder available.

U.S. Pat. No. 1,645,881 discloses a target practice apparatus for revolvers which includes a light projecting cartridge for insertion in one chamber of the revolver, with the light projecting cartridge forming one terminal of a suitable conductor leading to a battery. A second or retainer cartridge is inserted in a second chamber of the revolver serving as a terminal for the opposite side of the battery and so cooperating with the firing mechanism of the cylinder of the revolver as to retain the chamber carrying the light projecting cartridge in alignment with the bore of the gun barrel during successive firing operations. This apparatus can only be used in a revolver since a weapon such as an automatic pistol would not have a second cylinder available.

The present invention as claimed is intended to provide a marksmanship training apparatus which eliminates many of the prior art deficiencies which include a change in the sighting and weight of the weapon caused by cumbersome units attached to the outside of the weapon. Many prior art units change the "feel" of the weapon and add vision impairment as well as change the center of gravity of the weapon. Many prior art units require a temporary modification of the weapon. Many prior art units are usable on only one type of weapon. Prior art units did not address a solution for the interference of the apparatus by ambient light being emitted from alternating voltage (current) lighting systems, direct current lighting systems or the sun.

SUMMARY OF THE INVENTION

The present invention provides apparatus for simulated firing of projectile-type weapons and comprises a substitute cartridge and a receiver/detector target device. The substitute cartridge is self-contained and includes an energy emitting means to emit a pulse or pulses of energy, a lens or other collimation device to concentrate the energy emitted, a power source, an energy activation device and a transfer device to transfer the energy from a firing mechanism of the weapon to the energy activation device to activate the energy activation device and apply power from the power source to the energy emitting means. Shock absorbing means is associated with the transfer device to spread the excess force or impact of energy received from the firing mechanism, which is not required to activate the energy activation device, to the substitute cartridge. The receiver/detector target device includes a suitable energy detector with circuitry which only responds to the output of the energy detector which results from the reception of a pulse or pulses of energy and the circuitry does not respond to the output which results from the ambient light to which the energy detector is subjected. An additional embodiment may include circuitry which initiates a time cycle and provides a display of the elapsed time from initiation to the receipt of a hit from the pulse of energy emitted from the substitute cartridge in the weapon. An audio, mechanical or energy indication (at the apparatus or remote therefrom) may also be provided when a hit occurs.

Among the advantages offered by the present invention are a substitute cartridge that is self-contained and does not require any changes to be made to the weapon. The present invention does not change the sighting, weight or feel of the weapon. The present invention can be provided for use with any weapon including rifles, pistols, shotguns, etc. The present invention may provide a visual, mechanical, energy indication and/or an audio indication of a hit. The present invention responds only to a pulse or pulses of energy of predetermined characteristics and ignores the ambient light conditions.

Examples of the more important features and advantages of this invention have thus been summarized rather broadly in order that the detailed description thereof that follows may be better understood and in order that the contribution to the art may be better appreciated. There are, of course, additional features of the invention that will be described hereinafter and which will also form the subject of the claims appended hereto. Other features of the present invention will become apparent with reference to the following detailed description of a presently preferred embodiment thereof in connection with the accompanying drawing, wherein like reference numerals have been applied to like elements in which:

DESCRIPTION OF THE PREFERRED EMBODIMENT

For convenience and clarity of illustration, the present invention is described herein with particular reference to use thereof in connection with a standard weapon. It will be appreciated, however, that the invention is not so limited. Instead, the apparatus is adaptable for use in connection with a wide variety of weapons. It is only necessary that the weapon have a cartridge chamber to hold a cartridge in position for firing and a firing mechanism for causing the cartridge to fire. Additionally, with suitable modifications to the invention, this invention could be used in weapons using non-mechanical means, such as electrical heating, to fire a round. The suitable modifications are presently known by those versed in the appropriate fields of concern.

The present invention is also described herein with particular reference to the use of a pulse or pulses of light energy in the operation thereof. It will be appreciated, however, that the invention is not so limited and the operation thereof could use other forms of energy.

Figure 1:
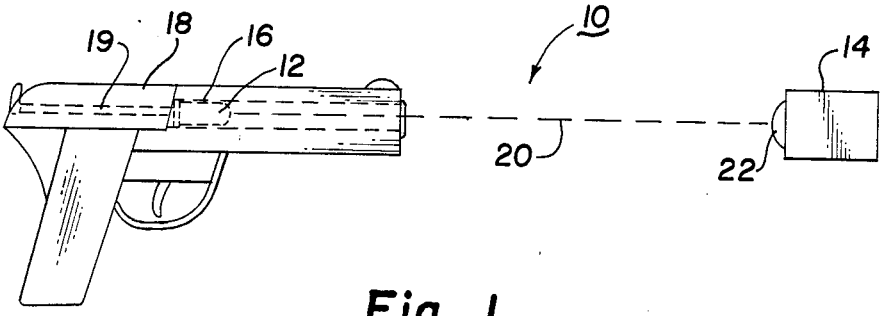
FIG. 1 is a simplified elevational view of a typical weapon provided with the present invention.
Figure 2:
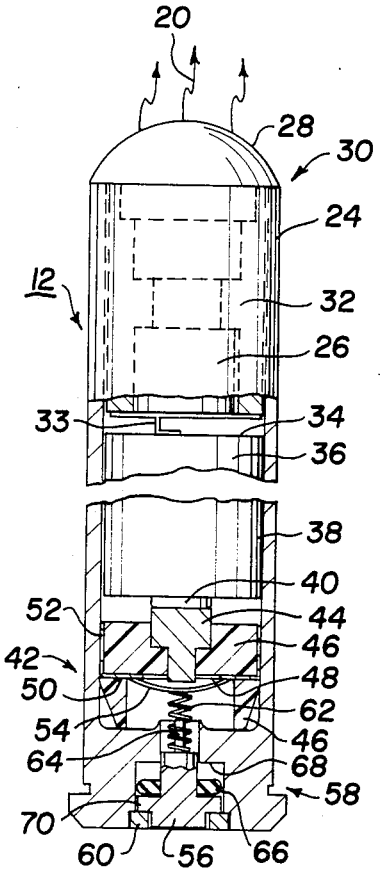
FIG. 2 is a simplified elevational view of the substitute cartridge, partially in section, of the present invention.
Figure 3:
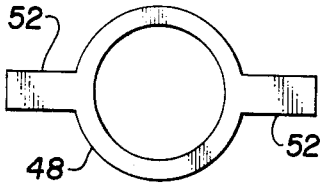
FIG. 3 is a simplified top plan view of the contact ring of the substitute cartridge.

Referring now to the drawing wherein like reference numerals designate like or corresponding elements throughout the several views, marksmanship training apparatus is referred to generally by reference numeral 10. The marksmanship training apparatus is shown in FIG. 1 comprising a substitute cartridge 12 which can be used in conjunction with a receiver/detector target device 14. The substitute cartridge 12 is loaded into the cartridge chamber 16 of weapon 18. When weapon 18 is fired, energy 20 in the form of light is emitted from the substitute cartridge 12 toward the receiver/detector target device 14. The light energy 20 is a pulse of light which has a sharp rise time of less than 8 milliseconds. Collector lens 22 collects light energy 20, internal circuitry detects the light energy 20 and provides a visual and/or audible indication of a hit on the receiver/detector target device 14. Collector lens 22 may be one of many available types such as a cone-optic lens, a fresnel lens etc. which collects and concentrates the light energy 20.

With reference to FIGS. 1–5, the substitute cartridge 12 comprises an electrically conductive cartridge casing or housing 24 which is configured and structured to fit into the cartridge chamber 16 of a weapon 18. It will be apparent that the substitute cartridge 12 will be of different sizes and shapes for weapons of different calibers. The physical exterior of each caliber of substitute cartridge 12 will not be mechanically different from a "real" or "live" cartridge. An energy emitting means 26 and lens means 28 are positioned and maintained in a first end 30 of the electrically conductive cartridge casing 24 by holder 32. In the preferred embodiment, energy emitting means 26 comprises a light emitting diode which emits a pulse of light when activated. It is important that the pulse of light have a rise time of less than 8 milliseconds. Some typical light emitting diodes for use in the present invention are TRW OP 123 or Honeywell SE5470-4. Lens means 28 may be a separate element or may be combined with the energy emitting means 26 to be a part thereof and be a single unit. Lens means 28 should be of a type which will tend to collimate and/or concentrate the light energy 20 which is emitted from energy emitting means 26.

One terminal of the energy emitting means 26 is connected to the cartridge casing 24 through the housing of the energy emitting means 26 which is mounted in a pressure fit in the holder 32. Holder 32 is electrically conductive and is mounted by conventional means such as threaded, pinned, etc. in first end 30 of cartridge casing 24. The other terminal 33 of the energy emitting means 26 is in contact with a first terminal 34 of the power source 36. Power source 36 could be any suitable battery, such as the DURACELL D393. The power source 36 is insulated from the cartridge casing 24 by insulation 38. The second terminal 40 of the power source 36 is connected by pressure contact to energy activation means 42. In the preferred embodiment, energy activation means 42 is a snap-action type switch (a dome switch) and comprises stationary terminal 44 which is supported by insulation means 46. Contact ring 48 fits within cutout 50 formed in insulation means 46. Contact ring 48 is electrically conductive and includes tabs 52 which are positioned at right angles to the main body of contact ring 48 to contact cartridge casing 24. Movable terminal 54 is seated around its periphery on contact ring 48. In the preferred embodiment, movable terminal 54 comprises a domed or cupped disc whose center is displaced when pressure is applied thereto. When movable terminal 54 is displaced such as to contact stationary terminal 44, energy emitting means 26 is activated and emits a pulse or pulses of energy.

Transfer mechanism 56 is positioned in the second end 58 of cartridge casing 24 to transfer the energy imparted by the firing mechanism 19 of the weapon 18 to energy activation means 42 to activate said energy activation means 42 by forcing movable terminal 54 in contact with stationary terminal 44. Transfer mechanism 56 is mounted for axial movement in cartridge casing 24 and is retained therein by retainer means 60, which is ring-like in structure. Transfer mechanism 56 includes resilient means 62 positioned between a first end 64 of transfer mechanism 56 and movable terminal 54 of energy activation means 42. Resilient means 62 is critical to the operation of the domed or cupped disc of movable terminal 54. As transfer mechanism 56 is moved toward the first end 30 of cartridge casing 24, after receiving energy transferred from firing mechanism 19, resilient means 62 pushes against movable terminal 54. As the force increases, the dome or cupped disc starts flattening out. After a certain point is reached, a snap action occurs and the dome or cupped disc is driven into stationary terminal 44 by and because of the resiliency of resilient means 62. If the first end 64 of transfer mechanism 56 were to be used to depress the dome or cupped disc of movable terminal 54, movable terminal 54 would not move into contact with stationary terminal 44 and energy activation means 42 would not be activated by the action of firing mechanism 19 and transfer mechanism 56. Instead, the dome or cupped disc of movable terminal 54 would be deformed to the point where energy activation means 42 would be inoperable.

Not all of the energy transferred from the firing mechanism 19 is needed to activate energy activation means 42. Also, the amount of energy transferred by the firing mechanism 19 may vary from weapon to weapon. Therefore, shock absorbing means 66 is positioned between extension 70 of transfer mechanism 56 and shoulder 68 of cartridge casing 24 to transfer or spread the excess force or impact of energy received from the firing mechanism 19, which is not required to activate energy activation means 42, to the cartridge casing 24. Shock absorbing means 66 may be comprised of an O-ring, a spring, etc.

For the greatest reliable and repeatable operation of the present invention, it is desirable that a snap-action type switch be used as the energy activation means 42. The action of the prior art mechanical action switches would provide a momentary contact and would not give a reliable and repeatable firm contact with minimum electrical resistance and insure a minimum rise time of the pulse of light emitted from the substitute cartridge 12. The snap-action type switch does provide a more reliable and a more repeatable firm contact with minimum electrical resistance and insures a minimum rise time of the pulse of light emitted from the substitute cartridge 12. The snap-action type switch provides a motion which is primarily controlled, both in duration and in the action of the snap, in making positive contact between the poles of the switch. This motion is provided by the spring action of the lever arm in either the dome switch of FIG. 2 or in the W spring configuration of FIG. 4*b*. The use of a snap-action type switch will provide a repeatable rise time to the pulse of light and will eliminate the requirement to provide a mechanical switch activation mechanism which would have a precisely repeatable mechanical travel. The spring action of the spring-action type switch allows the use of greater tolerances on the transfer mechanism 56 and the shock absorbing means 66.

Figure 4A:
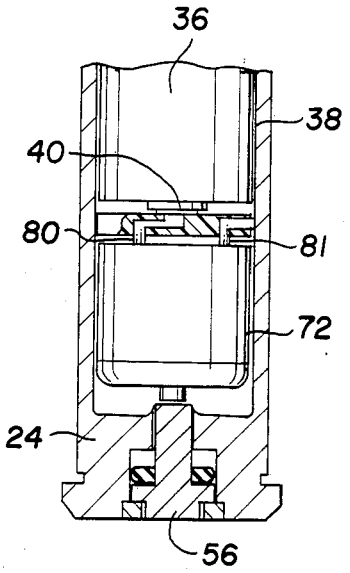
FIG. 4*a* is a simplified elevational view of an alternate embodiment of the substitute cartridge, partially in section, of the present invention.
Figure 4B:
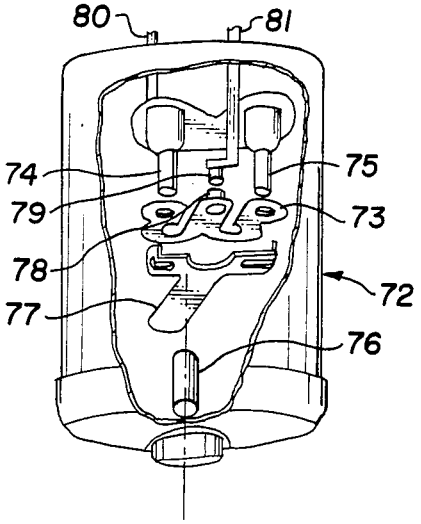
FIG. 4*b* is a simplified exploded view of an alternate energy activation means provided in the substitute cartridge of FIG. 4*a;*

FIGS. 4*a* and 4*b* disclose another embodiment of a snap-action type switch, such as the KLIXON AT series of switches from Texas Instruments, for connecting the second terminal 40 of power source 36 to cartridge casing 24. In this embodiment, the energy activation means 72 utilizes a W-spring element 73 which is held in place by mounting posts 74 and 75. The movement of transfer mechanism 56 causes plunger 76 to contact arm 77 which applies a force to W-spring element 73 resulting in a twisting action of the W-spring element 73. The twisting action generates a snap-action of contact 78 against contact 79 which results in continuity between the external terminals 80 and 81. Terminal 80 is connected to second terminal 40 and terminal 81 is connected to cartridge casing 24 by conventional means. This commercially available snap-action type switch is suitable both in its mechanical size and in its precise snap-action electrical performance for use in the present invention. The energy activation means 42 of FIG. 2 may be replaced by the above-described snap-action W-spring configuration switch with all the remaining elements functioning as before. Other configurations of snap-action switches which can be mechanically configured to fit within the required space may be used in place of the W-spring type of snap-action switch.

Figure 5:
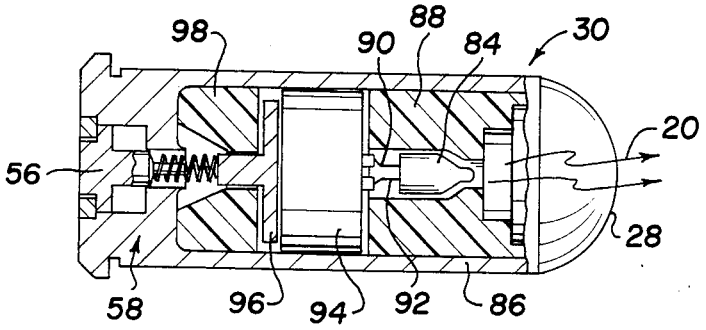
FIG. 5 is a simplified elevational view of another alternate embodiment of the substitute cartridge, partially in section, of the present invention.

FIG. 5 discloses another embodiment of substitute cartridge 12. An energy emitting means 84 and lens means 28 are positioned and maintained in a first end 30 of cartridge casing 86 by holder 88. In the preferred embodiment, energy emitting means 84 comprises a gas-filled glass envelope with the gas being activated by a voltage being applied across leads 90 and 92. Some typical energy emitting means 84 include standard photographic strobe tubes, neon bulbs, xenon bulbs or other such small bulbs containing a single gas or a mixture of gases selected from Ar, Ne, Xe, etc. but not limited thereto. As before, it is important that the pulse of energy emitted from energy emitting means 84 have a rise time of less than 8 milliseconds. Neither the cartridge casing 86 nor the holder 88 need to be electrically conductive. Energy emitting means 84 is supported in and by holder 88. The power source comprises a piezoelectric device 94, such as lead zerconate titanate (PZT) or "poled" ceramic composition with perovskite crystalline structure. The piezoelectric device 94 is positioned and mounted between holder 88 and plunger 96 with plunger 96 being mounted for axial movement within guide means 98. Transfer mechanism 56 transfers to plunger 96 the energy received from the firing mechanism 19 of the weapon. The mechanical force applied to the piezoelectric device 94 by the plunger 96, when activated by the transfer mechanism 56, causes the piezoelectric device 94 to be mechanically stressed between the plunger 96 and the holder 88 and generates an output voltage on leads 90 and 92, which are connected to the output terminals of the piezoelectric device 94. Another embodiment could include a spark gap instead of the flash tube.

Figure 6:
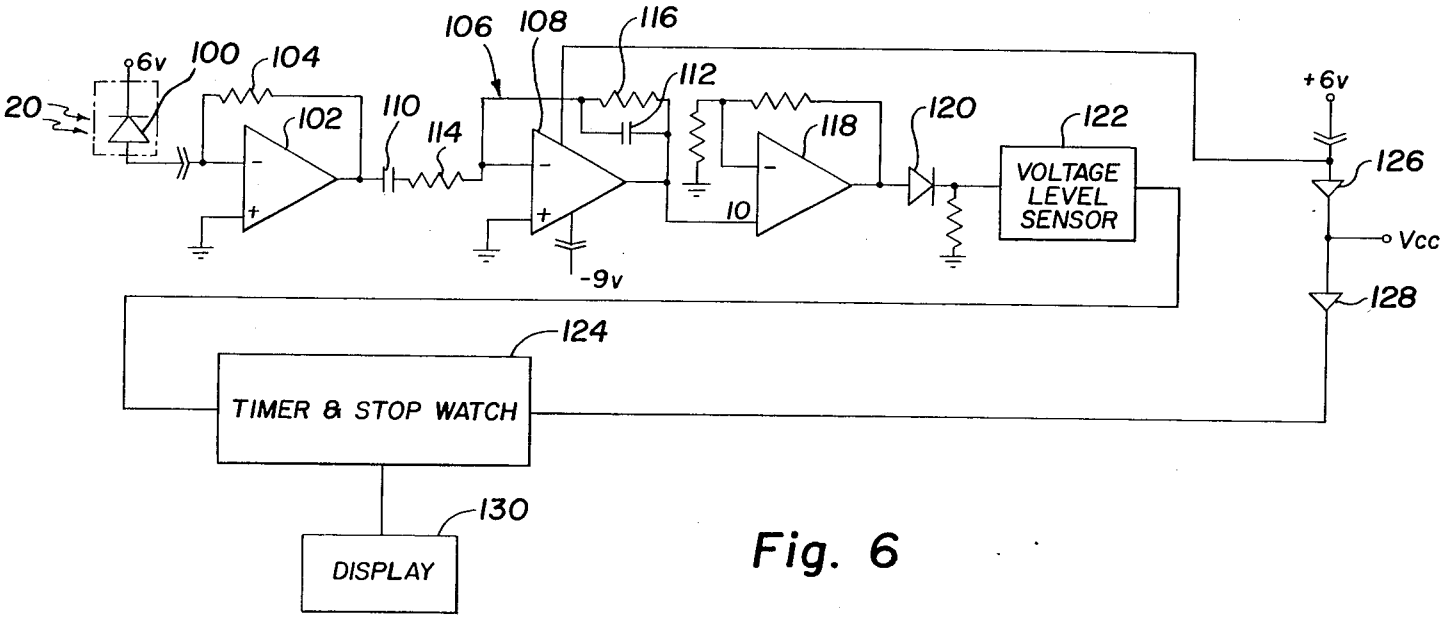
FIG. 6 is a simplified schematic, partially in block diagram form, of the receiver/detector device of the present invention.

With reference to FIG. 6 which discloses the receiver/detector target device 14, light energy 20 from the substitute cartridge 12 is collected by collector lens 22 and detected by energy detector 100 whose output is provided to the negative input of op amp 102. Op amp 102 together with resistor 104 reverse biases energy detector 100 and maintains that reverse bias at a constant level regardless of the level of ambient light to which energy detector 100 is exposed. The output of op amp 102 is provided to differentiator 106 which comprises op amp 108, capacitors 110 and 112 and resistors 114 and 116. Differentiator 106 provides a voltage on its output which is proportional to the rise time (or rate-of-change) of the signal on its input. Therefore, differentiator 106 eliminates the sixty hertz or similar consumer line voltage alternating system imposed signal which is in the ambient light to which the energy detector 100 is subjected by not providing any usable voltage on its output from any sixty hertz or related signals in the ambient light but will provide a usable voltage for a pulse of energy which has a sharp rise time, the limits of which are defined by the selected components within the differentiator circuit.

The output of differentiator 106 is provided to op amp 118 which is a gain block with a resistor selectable gain of approximately one hundred. The output of op amp 118 is provided to diode 120 whose output is provided to voltage level sensor 122. Voltage level sensor 122 comprises Schmitt trigger circuitry such that the voltage level sensor 122 provides an output signal to the timer and stop watch circuitry 124 only after the input signal to the voltage level sensor 122 has exceeded a threshold value and then drops a predetermined amount below that threshold value. This feature assures that the receiver/detector target device 14 only responds to energy having a minimum threshold value. Vcc and six volt supplies are provided through isolation diodes 126 and 128. The timer and stop watch circuitry 124 is output to display 130 which in the preferred embodiment comprises an LED display of a predetermined number of digits.

The timer and stop watch circuitry 124 comprises off the shelf chips including flip flops (74LS 74 and 74LS 123), AND gates (74LS02 and 74LS14) and a buzzer. When the receiver/detector target device 14 is initially turned on, the stop watch is reset and starts counting with the count being displayed on the LED display 130. When the pulse or pulses of light energy 20 is detected by the circuit, the buzzer is activated and the stop watch is stopped with the time displayed on the display 130 at the length of time which has elapsed from the time of initiation. The display 130 is held at the count or time at which the hit occurs, then it is blanked, the stop watch is reset and the cycle repeats. If at the end of the time out of the stop watch time, a pulse or pulses of light energy 20 has not been detected, the stop watch will reset and the cycle will be repeated.

Figure 7:
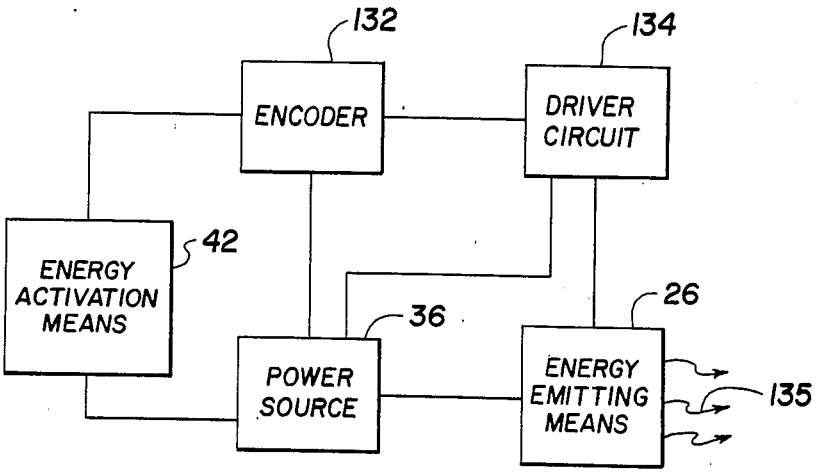
FIG. 7 is a simplified schematic, in block diagram form, of an alternate embodiment of the substitute cartridge of the present invention.
Figure 8:
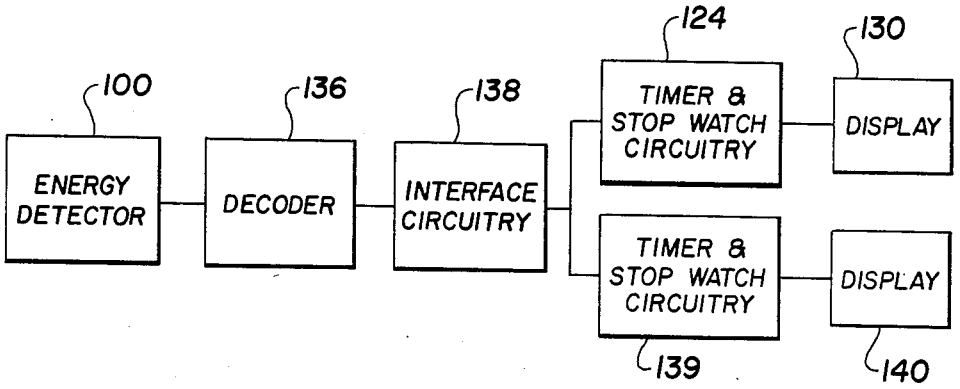
FIG. 8 is a simplified schematic, in block diagram form, of an alternate embodiment of the receiver/detector device of the present invention.

FIGS. 7 and 8 disclose an additional embodiment of the marksmanship training apparatus 10 which uses hybrid microelectronic circuitry similar to that used in the miniaturization of the electronic wrist watch and which utilizes a coded series of pulses which can be used to distinguish between multiple users of the marksmanship training apparatus 10. With reference to FIG. 7, encoder 132 is activated when energy activation means 42 is activated, by the firing mechanism of the particular weapon being used, and applies power from power source 36 to encoder 132. The encoded output (pulse width, internal, count coding, etc.) of encoder 132 is applied as an input to driver 134 whose output activates energy emitting means 26. A semiconductor chip such as National Semiconductor LM1871 (or equivalent) could be assembled on a substrate suitable for mounting thin or thick film resistors and semiconductor chips. This substrate with the support components mounted upon it would provide the encoder function. The substrate could be mounted in the package which contains the infrared emitting diode or could be sandwiched between the battery and the LED holder as a round substrate.

With reference to FIG. 8, energy detector 100 receives the encoded emitted energy 135 from energy emitting means 26 and provides an output to decoder 136 which performs the decoding function required. A semiconductor chip such as National Semiconductor LM1872 (or equivalent) could be used to provide the decoding function. The output of decoder 136 is provided to interface circuitry 138. The particular design configuration of the interface circuitry 138 will vary depending upon whether the analog or digital output of the decoder 136 is used. The output of the interface circuitry 138 is then output to the particular timer and stop watch circuitry 124, 139 and additional timer and stop watch circuitry as desired and which would be limited in number by the particular encoder and decoder used in the marksmanship training apparatus 10. Displays 130, 140 and additional displays to equal the number of timer and stop watch circuitry used in the apparatus would be operatively connected to their respective circuits. When the marksmanship training apparatus 10 was being used by more than one person, the encoder 132 in each substitute cartridge 12 would provide a different encoded signal which would be unique to that cartridge. When a hit was recorded on the energy detector 100, then the display associated with that particular substitute cartridge (and its unique code) would display the hit and the time associated therewith to show which person (cartridge) had been successful.

Thus, it is apparent that there has been provided in accordance with this invention, marksmanship training apparatus that substantially incorporates the advantages set forth above. The marksmanship training apparatus incorporates a substitute cartridge and a receiver/detector target device. The substitute cartridge is self contained by including all the elements within the casing. It can be provided in any caliber, for any weapon including rifles, pistols, shotguns, etc. The energy emitting means in the substitute cartridge provides a pulse or pulses of energy with a sharp rise time. The receiver/detector target device responds only to the pulse or pulses of energy and ignores the ambient light level to which it is subjected.

Although the present invention has been described in conjunction with specific forms thereof, it is evident that many alternatives, modifications and variations will be apparent to those skilled in the art in light of the foregoing disclosure. Accordingly, this description is to be construed as illustrative only and is for the purpose of teaching those skilled in the art the manner of carrying out the invention. It is understood that the forms of the invention herewith shown and described are to be taken as the presently preferred embodiment. Various changes may be made in the shape, size and arrangement of parts. For example, equivalent elements may be substituted for those illustrated and described herein, parts may be reversed, and certain features of the invention may be utilized independently of other features of the invention. It will be appreciated that various modifications, alternatives, variations, etc., may be made without departing from the spirit and scope of the invention as defined in the appended claims.

What is claimed is:

1. Marksmanship training apparatus for a weapon having a barrel, a cartridge chamber to hold a cartridge in position for firing and a firing mechanism for causing the cartridge to fire, said marksmanship training apparatus comprising:

an electrically conductive cartridge casing structured for disposition in the cartridge chamber of said weapon, said electrically conductive cartridge casing having a first end and a second end;

energy emitting means positioned to emit energy from said first end of said electrically conductive cartridge casing when activated, said energy being a pulse of energy with a rise time of less than 8 milliseconds;

a power source positioned within said electrically conductive cartridge casing and connected to said energy emitting means;

energy activation means positioned within said electrically conductive cartridge casing and electrically connected to complete an electrical circuit through said energy emitting means, said electrically conductive cartridge casing, said power source and said energy activation means when said energy activation means is activated to the on position by the firing mechanism of said weapon and thereby activate said energy emitting means; and a transfer mechanism mounted for axial movement within said electrically conductive cartridge casing and positioned between said energy activation means and said second end of said electrically conductive cartridge casing to transfer the energy imparted by said firing mechanism to said energy activation means to activate said energy activation means;

said energy activation means comprises a snap action switch including a stationary terminal which is electrically connected to the power source and movable terminal which is positioned to be contacted by said transfer mechanism and moved to contact said stationary terminal to activate said energy activation means;

said movable terminal comprises a disc which is rigidly supported around the periphery thereof and includes a cupped portion which protrudes from said periphery in the direction of said transfer mechanism.

2. The apparatus of claim 1 wherein said emitted energy is in the form of light.

3. The apparatus of claim 1 wherein said energy activation means comprises a snap-action type switch.

4. The apparatus of claim 1, wherein said transfer mechanism includes resilient means which is positioned in contact with said cupped portion of said disc.

5. The apparatus of claim 1 further including means for absorbing shock which is positioned within said electrically conductive cartridge casing such as to be contacted by said transfer mechanism when said transfer mechanism is moved by said firing mechanism.

6. The apparatus of claim 1 further including lens means positioned at said first end to collimate said energy emitted from said energy emitting means.

7. The apparatus of claim 2 wherein said pulse of light emitted from said energy emitting means is invisible to the human eye.

8. The apparatus of claim 2 wherein said pulse of light emitted from said energy emitting means is visible to the human eye.

9. Markmanship training apparatus for use with a weapon having a barrel, a cartridge chamber to hold a cartridge in position for firing and a firing mechanism for causing the cartridge to fire, said marksmanship training apparatus comprising:

an electrically conductive cartridge casing structured for disposition in the cartridge chamber of said weapon, said electrically conductive cartridge casing having a first end and a second end;

energy emitting means positioned to emit energy from said first end of said electrically conductive cartridge casing when activated, said energy being a pulse of energy with a rise time of less than 8 milliseconds;

a power source positioned within said electrically conductive cartridge casing and connected to said energy emitting means;

energy activation means positioned within said electrically conductive cartridge casing and electrically connected to complete an electrical circuit through said energy emitting means, said electrically conductive cartridge casing, said power source and said energy activation means when said energy activation means is activated to the on position by the firing mechanism of said weapon and thereby activate said energy emitting means;

a transfer mechanism mounted for axial movement within said electrically conductive cartridge casing and positioned between said energy activation means and said second end of said electrically conductive cartridge casing to transfer the energy imparted by said firing mechanism to said energy activation means to activate said energy activation means; and means for indicating the reception of said pulse of energy;

said energy activation means comprises a snap action switch including a stationary terminal which is electrically connected to the power source and a movable terminal which is positioned to be contacted by said transfer mechanism and moved to contact said stationary terminal to activate said energy activation means;

said movable terminal comprises a disc which is rigidly supported around the periphery thereof and includes a cupped portion which protrudes from said periphery in the direction of said transfer mechanism.

* * * * *